United States Patent [19]

Harrelson et al.

[11] 3,945,560

[45] Mar. 23, 1976

[54] PACKAGE LOCK

[75] Inventors: Glen R. Harrelson, Gulf Breeze, Fla.; Earle C. Sherman, West Monroe, La.

[73] Assignee: Olinkraft, Inc., West Monroe, La.

[22] Filed: Jan. 20, 1975

[21] Appl. No.: 542,153

[52] U.S. Cl. ..... 229/40; 206/140; 53/48

[51] Int. Cl.[2] ..... B65D 5/04; B65D 75/08

[58] Field of Search ..... 229/40, 39; 206/140; 53/48

[56] References Cited

UNITED STATES PATENTS

| | | | |
|---|---|---|---|
| 2,990,997 | 7/1961 | Weiss | 229/40 |
| 3,098,583 | 7/1963 | Sherman et al. | 206/140 |
| 3,220,155 | 11/1965 | Sherman | 53/48 |
| 3,384,291 | 5/1968 | Graser | 229/40 |
| 3,395,791 | 8/1968 | Graser | 229/40 X |
| 3,679,121 | 7/1972 | Morgese | 229/40 |
| 3,680,765 | 8/1972 | Harrelson | 229/40 |

*Primary Examiner*—Davis T. Moorhead

*Attorney, Agent, or Firm*—Norvell E. Von Behren

[57] ABSTRACT

An improved package lock is disclosed that may be used in a folding carton package of the type having an inner and outer flap which are double locked together, that is with at least one primary lock utilized in combination with at least one secondary lock with the secondary lock functioning to keep the primary lock from disengaging. The subject invention comprises the inner flap having formed thereon a primary female lock adjacent to the edge of the inner flap and the inner flap also having formed adjacent and separate from the primary lock, a secondary male lock. The new and improved lock structure may be utilized for an end-loading type package and also for a wrap-around type package.

21 Claims, 15 Drawing Figures

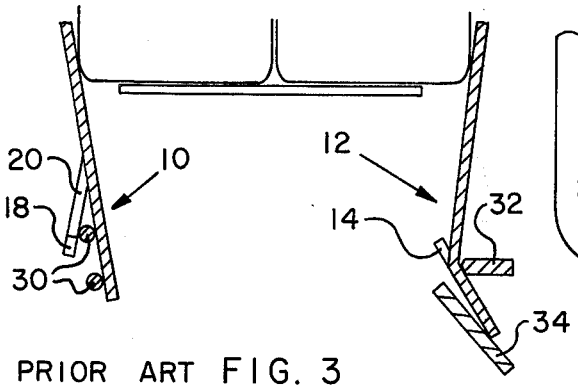
PRIOR ART FIG. 3
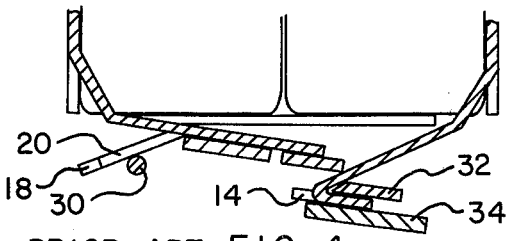
PRIOR ART FIG. 4
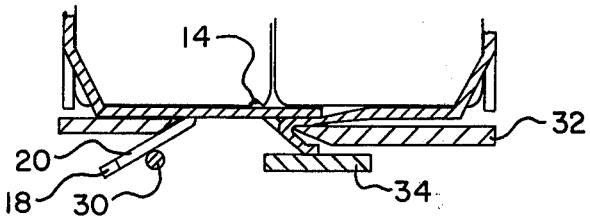
PRIOR ART FIG. 5
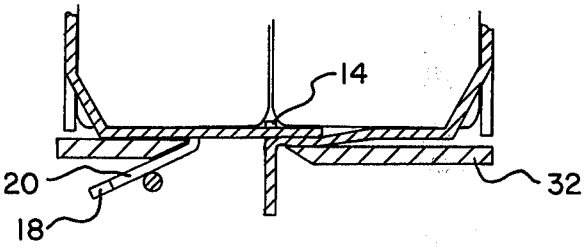
PRIOR ART FIG. 6
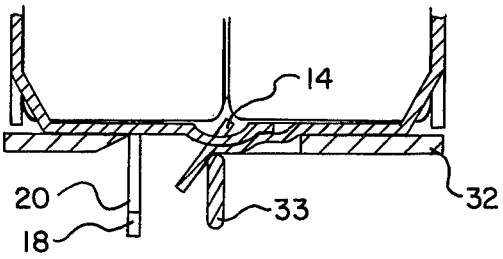
PRIOR ART FIG. 7
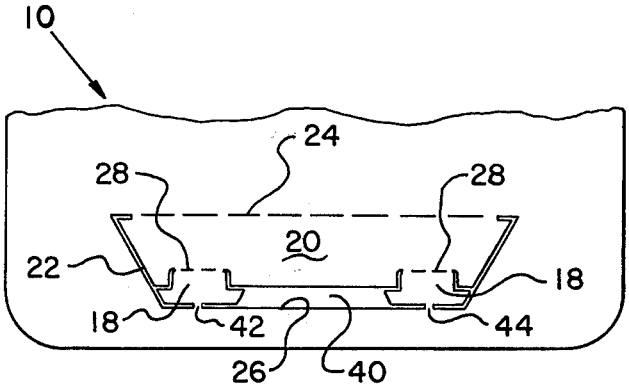
PRIOR ART FIG. 10
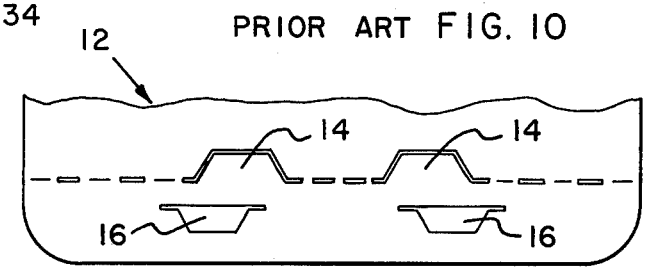
PRIOR ART FIG. 11
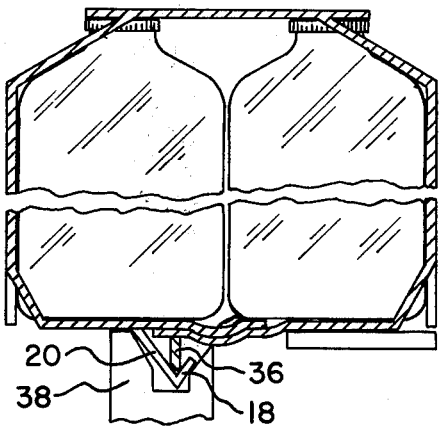
PRIOR ART FIG. 8
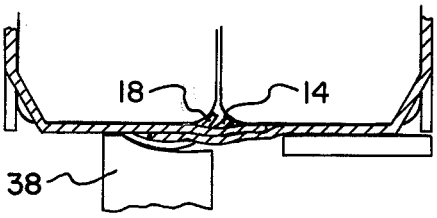
PRIOR ART FIG. 9

PACKAGE LOCK

BACKGROUND OF THE INVENTION

This invention relates generally to article retaining packages and more specifically relates to a new and improved mechanical lock which may be utilized in various types of packages where a double lock feature is desired.

In recent years it has been customary to pack small, uniform articles such as cans, bottles or similar items in groups by arranging the articles in plural rows and end loading the articles in a preformed package of a sheet of packaging material such as paper, plastic or a composite of paper and plastic board. After the articles are end loaded in the preformed packages, the sides of the package are then held tightly closed by the use of at least one primary locking structure in combination with a secondary locking structure. An example of this type of package is shown in FIG. 1 of the applicants' drawing and would be utilized for example, to package a plurality of 12 cans or bottles of a soft drink or some other beverage.

In recent years it has also been customary to package small, uniform articles such as cans, bottles or similar items in groups by arranging the articles in single or plural rows and encircling a definite number of articles with a wrapper which is characterized by a sheet of packaging material such as paper, plastic or a composite of paper and plastic board. After the articles are thusly encircled, the ends of the package are held tightly together by means of a similar beforementioned combination of at least one primary lock structure with a secondary lock structure. An example of this type of package is shown in FIG. 2 of the drawing and may be utilized for packaging not only bottles but also cans of soft drinks or other beverages.

Group packaging of the latter type requires that the wrapper be drawn tightly about the articles because retention of the articles within the package is a function of how tautly they are wrapped in the package. Group packaging of the former type articles requires also that the wrapper be permanently locked in place by the use of the double lock to prevent the ends of the package from separating and resulting in a droppage of the articles from the carrier. It is important to be able to positively retain the cans or bottles in the package to prevent injury to the consumer in the event the cans or bottles should separate from the package due to a malfunction in the package lock.

In order to understand more fully the applicant's new and improved package lock there is shown in the drawings and in particular in FIGS. 10 and 11 of the drawing a prior art type of package lock which will be described in some detail along with the structural locking steps involved in locking the package together in order to more fully understand the problems encountered in the utilization of a double lock. FIGS. 3–9 show in detail the locking sequence utilized for locking a double lock such as that shown in FIGS. 10 and 11 of the drawing and also would be the same sequence of locking steps that would be utilized in locking the applicant's new and improved package lock. This type of prior art double lock which has many variations, is also detailed along with the locking sequence in the U.S. Pat. No. 3,220,155, issued to E. C. Sherman on Nov. 30, 1965 and also in other U.S. patents issued and referred to in that patent.

By referring now to the prior art representation shown in FIGS. 10 and 11 of the drawing there will be described more fully the prior art version of the double lock along with some of the problems encountered in the use of this type of double lock.

A double lock of the type herein referred to comprises an inner flap shown generally by the numeral 10 as well as an outer flap shown generally by the numeral 12, with the outer flap 12 being overlapped and positioned to the outside of the package and with the inner flap 10 being positioned inside the package. The outer flap 12 contains a plurality of primary male locking tabs 14 along with a plurality of secondary female locking openings 16. The inner flap 10 contains a plurality of secondary male locking tabs 18 which are hingedly formed on an elongated tab 20 and which form the primary female locking opening 22 whenever the elongated tab 20 is hinged along scoreline 24 and is pivoted at an angle away from the plane of the inner flap 10.

Whenever the double carton lock shown in FIGS. 10 and 11 is locked in place, the primary male locking tabs 14 are positioned to be secured about the line surface 26 as will be more fully described hereinafter when referring to FIGS. 3–8 and the secondary male locking tabs 18 are positioned within the secondary female locking openings 16 after being bent about the scorelines 28. This beforedescribed locking, is also shown in the U.S. Pat. No. 3,098,583, issued to E. C. Sherman et al. on July 23, 1963, and is shown in particular in FIGS. 3–6 of that patent.

It can be seen that problems present themselves in that the primary female locking opening 22 is totally dependent upon the position and the size of the secondary male locking tabs 18 resulting in limitations being placed on the designer in positioning his locking elements at a place of his own choosing. Because of the limitation placed upon the position and size of the primary female locking opening 22 in respect to the secondary male locking tabs 18, the spacing of the primary male locking tabs 14 in relation to the secondary female locking opening 16 is also controlled resulting in extremely small spaces within which to effect the lock which will now be described.

By referring to FIGS. 3–9 of the drawing there is shown the locking sequence in effecting the double lock hereinbefore described with FIG. 3 showing the first step wherein the inner flap 10 is folded inwardly of the package and has its elongated tab 20 folded outwardly by means of a plurality of guide bars 30. At the same time the outer flap 12 is folded inwardly while having its primary male locking tabs 14 folded outwardly by means of a plurality of folding rails 32 and 34.

FIG. 4 depicts the next step in the folding sequence wherein the inner flap 10 is folded inwardly at a much greater angle to be positioned inside the outer flap 12 while the primary male locking tab 14 is folded, by means of the folding rails 32 and 34, into a position prior to inserting it in the primary female locking opening 22. FIG. 5 shows the insertion of the primary male locking tabs 14 into the primary female locking opening 22 after which the position of the primary male locking tab 14 is reversed and is repositioned to the position shown in FIG. 6. The reversal of primary male locking tab 14 is accomplished by means of the folding rail 32 and 33 as shown in FIGS. 6 and 7 of the drawing.

Reference should be now made to FIGS. 7 and 8 of the drawing wherein the elongated tab 20 has been repositioned prior to the insertion of the secondary male locking tabs 18 in the secondary female locking openings 16 which is shown in FIG. 8 of the drawing and which is accomplished by means of the folding rail 36 in combination with the block 38. The final step in the locking sequence is shown in FIG. 9 of the drawing where the block 38 then is utilized to insert the secondary male locking tabs 18 into the secondary female locking openings 16.

From the review of the above folding and locking sequence, it can be seen that extremely tight conditions are encountered due to the placement of the various locking parts and their relationship to their mating locking openings. It has been found that it would be more advantageous to be able to construct the primary and female parts so that they would be separate from each other and not controlled by one or the other's position which would allow for greater freedom in bending and positioning the various primary and secondary male locking members in their mating primary and secondary female openings. It was found that it would also be advantageous to separate the various locking elements which would eliminate the problem of scrapping out of the area 40 (shown in FIG. 10 of the drawing) which also required the placing of nicks 42 and 44 to prevent dislodgement of the secondary male locking tabs 18 during the scrapping out procedure.

SUMMARY OF THE INVENTION

In order to overcome the beforementioned problems and to provide an improved new and novel package lock there has been developed the improved locking structure of the subject invention which comprises forming the inner flap with a primary female lock adjacent to the edge of the inner flap and forming the secondary male lock adjacent and separate from the primary female lock. When thusly formed, the respective locking parts may be constructed of a predetermined size which is not controlled by another locking element of the complete lock structure.

Accordingly it is an object of the invention to separate the primary locking structure from the secondary locking structure in order to be able to make the primary locking structure longer to receive a larger primary locking tab without having to make the secondary locking tab larger.

Another object of the invention is to separate the primary lock from the secondary lock in order to be able to increase the distance between the respective locks and the point of entry of the secondary locking tab thereby reducing the angle of entry of the tab in effecting the carton lock.

Yet another object of the invention is to provide a primary female and male secondary locks which are separated to allow easier scrapping out of the primary female lock without having to disturb the secondary male lock.

Yet another object and advantage of the invention is to provide primary locks for a package which are totally independent of the secondary locks resulting in the use of larger and stronger locks on the package.

BRIEF DESCRIPTION OF THE DRAWINGS

FIGS. 3–9 are sectional views showing the folding sequence of the prior art and the applicant's locking structure;

FIGS. 10–11 show prior art type locking structures;

DESCRIPTION OF THE PREFERRED EMBODIMENT

Figure 1:
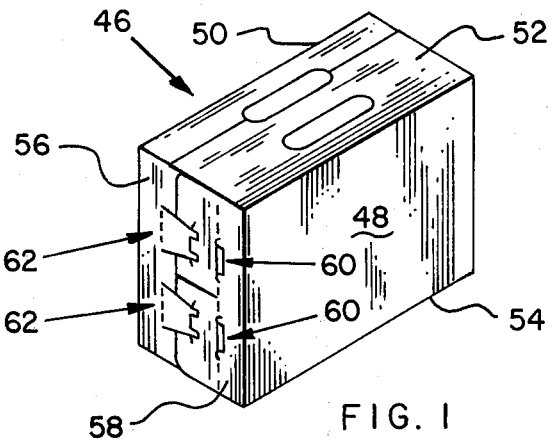
FIGS. 1–2 show packages of the type utilizing the applicant's improved locking structure.

Referring now to FIG. 1 of the drawing there is shown an end-filled type of package as beforementioned which is shown generally by the numeral 46 and which comprises a plurality of sides 48 and 50 as well as a top 52 and a bottom 54. The ends of the package comprise an inner flap 56 as well as an outer flap 58 on each end of the package. Holding these flaps together are a plurality of primary locks shown generally by the numeral 60 as well as a plurality of secondary locks shown generally by the numeral 62. The production blank for this type of package is shown more fully in FIG. 14 of the drawing and will be described more fully hereinafter.

Figure 2:
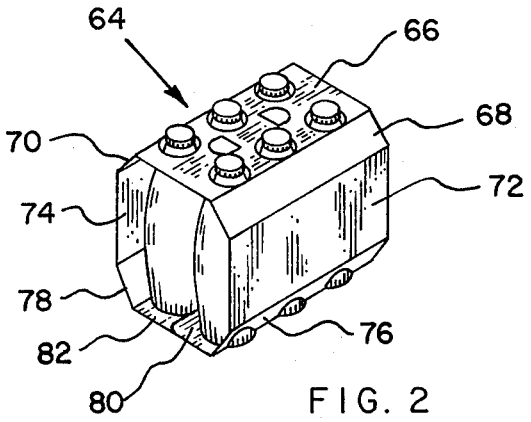

Referring now to FIG. 2 of the drawing there is shown the type of package often referred to as a "wrap-around" package and which is shown generally by the numeral 64 and comprises a top portion 66 having formed on each side thereof a plurality of sides 68 and 70 as well as a plurality of sides 72 and 74. The sides 72 and 74 have formed thereon at the lower portion thereof sides 76 and 78. The side 76 has formed thereon the inner flap 80 while the side 78 has formed thereon the outer flap 82. The locking of the inner flap 80 and the outer flap 82 together is accomplished by the beforementioned primary and secondary locks similar to the type shown locking the package in FIG. 1 but are not shown in the drawing FIG. 2. The production blank for this type of package is shown more fully in FIG. 15 of the drawing and will be described more fully hereinafter.

Figure 12:
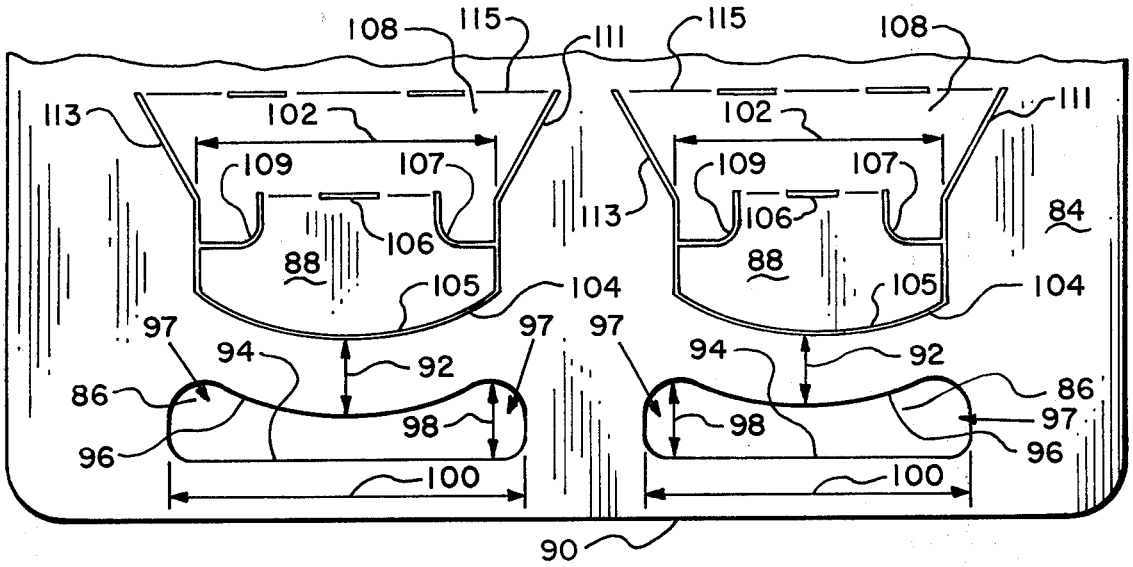
FIGS. 12–13 show the applicant's new and improved locking structure.
Figure 13:
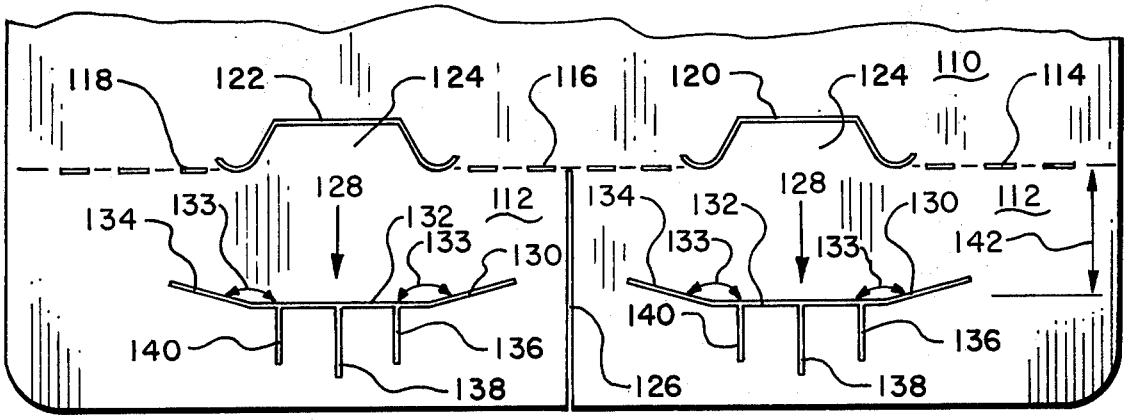

The locking of the package 46, end filled shown in FIG. 1, as well as the package 64, wrap around shown in FIG. 2, is accomplished by the same general method shown in the prior art FIGS. 3–9 of the drawings which is also the locking sequence which is utilized not only to lock together the prior art type lock shown in FIGS. 10 and 11 but the applicants' new and novel improved lock shown in FIGS. 12 and 13.

Referring now to FIG. 12 of the drawing there is shown the inner flap of the before described packages which would comprise the inner flap 56 for the package shown in FIG. 1 or the inner flap 80 for the package shown in FIG. 2. For the purpose of the remainder of this specification the inner flap 56 or the inner flap 80 will be collectively referred to as the inner flap numeral 84 which has formed thereon at least one primary female locking opening 86 as well as at least one secondary male locking tab 88. The primary female locking opening 86 is formed adjacent to the edge 90 of the inner flap 84 while the secondary male locking tab 88 is formed adjacent to but separate from the primary female locking opening 86. In the preferred embodiment shown, the separation, shown generally by the numeral 92, between the primary and the secondary locks is approximately one-eighth inch with the primary female locking opening 86 being formed as an elongated rectangular shaped opening having at least one straight edge portion 94 lying substantially parallel to the edge 90 of the inner flap 84. The edge 96 of the primary female locking opening 86 opposite to the straight edge portion 94 is formed in a generally curved semi-circular configuration which allows an end portion, shown generally by the numeral 97, to be sized approximately three-eighths inch. The three-eighths of an inch distance is shown by the arrow 98 and is the minimum distance needed to scrap out the material from the primary female locking opening 86.

By separating the male and female locks from each other as shown in FIG. 12 of the drawing the primary female locking opening 86 is able to be formed of a predetermined length, shown generally by the numeral 100, which is longer than the length, shown generally by the numeral 102, of the secondary male locking tab 88 resulting in a much stronger lock for the package.

The secondary male locking tab 88 is formed as an elongated tab having a hinged semi-circular portion 105 formed on the end thereof by means of the die cuts 104, 107, 109, 111 and 113 and is hingedly fixed, by means of the cut and scoreline 106 to the remaining portion 108 of the secondary male locking tab 88. The remaining portion 108 is hingedly attached to the inner flap 84 by means of the cut and scoreline 115. It has been found preferable to design the subject lock so that the semi-circular configuration of the hinged semi-circular portion 105 of the secondary male locking tab 88 is substantially the same radius as the radius of the semi-circular configuration of the edge 96 on the primary female locking opening 86.

Referring now to FIG. 13 of the drawing there will be shown in detail the mating outer flap of the respective packages which, for the purposes of the remainder of this specification will be hereinafter referred to as the outer flap 110 but which is the same outer flap referred to as the outer flap 58 in the package shown in FIG. 1 and the outer flap 82 of the package shown in FIG. 2.

The outer flap 110 has formed thereon at least one flap 112 which is formed by means of the cut and scoreline 114, 116, and 118 as well as the die cut lines 120 and 122. The die cut lines 120 and 122 form the primary male locking tab 124 which is designed to be positioned within the primary female locking opening 86 shown in FIG. 12 and to mate thereof with the straight edge portion 94 of that opening as has been more fully described hereinbefore.

In the preferred embodiment shown in FIG. 13 the flap 112 may be formed as two flaps which are separated by the cut line 126 and have formed thereon the secondary female locking openings shown generally by the numeral 128. These secondary female locking openings 128 comprise a plurality of die cut lines 130, 132 and 134 as well as a plurality of die cut lines 136, 138 and 140. When formed in this manner, the secondary female locking opening 128 is designed to receive the secondary male locking tab 88 with the hinged semi-circular portion 105 of the secondary male locking tab 88 being inserted into the secondary female locking opening 128 formed by the die cut lines 130, 132 and 134. In forming the die cut lines 136, 138 and 140 perpendicular to the die cut line 132, the area at the point of insertion of the secondary male locking tab 88 is weakened allowing the secondary male locking tab 88 easier entry into the secondary female locking opening 128. In addition the positioning of the cutline 130 and 134 at a predetermined angle of approximately 160 degrees to the cut line 132 serves the purpose of helping to retain the secondary male locking tab 88 from being inadvertently released from the secondary female locking opening 128 after insertion of the tab in the secondary female locking opening 128. The predetermined angle is shown generally by the numeral 133 in FIG. 13 of the drawing.

By virtue of fact that the primary female locking opening 86 has been separated from the secondary male locking tab 88, the primary male locking tab 124 may also then be separated at a predetermined distance from the secondary female locking opening 128. This separation is shown generally by the numeral 142 and results in more flexibility being built into the lock in that the heretofore tight tolerances built into the prior art lock shown in FIGS. 10 and 11 are not encountered in the applicant's new and novel lock shown in FIGS. 12 and 13.

Figure 14:
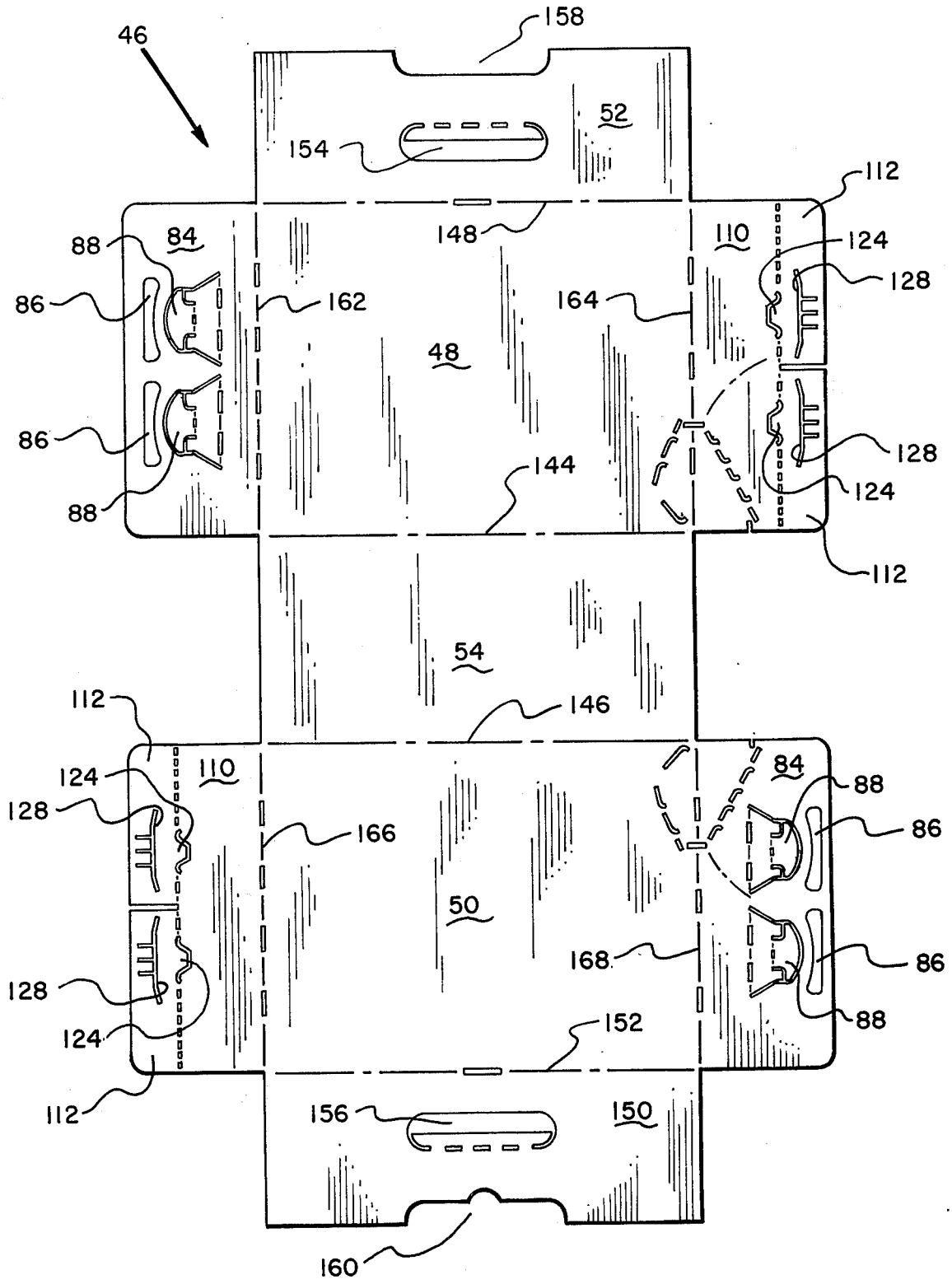
FIG. 14 shows a production blank as used for packaging a plurality of twelve cans or bottles and showing the applicant's new and improved locking structure positioned thereon.

Referring now to FIG. 14 of the drawing there is shown a production blank of the type of package shown in FIG. 1 of the drawing and comprises a centrally located bottom 54 having a pair of sides 48 and 50 hingedly attached thereto by means of the score lines 144 and 146. At least one of the sides 48 or 50 has formed thereon a top 52 by means of the scoreline 148. In the preferred embodiment shown the side 50 has also formed thereon a top panel 150 by means of the scoreline 152. Positioned centrally within each of the tops 52 and 150 if utilized, are openings 154 and 156 as well as a plurality of cutouts 158 and 160 which combine to form a handle opening for the end filled package 46. The side 48 has formed on one end thereof, by means of the cut and score line 162, an inner flap 84 and has formed on the other end thereof, by means of the scoreline 164, the outer flap 110 as well as the flap 112. In a similar manner the side 50 has formed on one side thereof, by means of the scoreline 166, an outer flap 110 as well as the panel 112 while the other end of the side 50 has formed thereon, by means of the scoreline 168, the inner flap 84.

The inner flap 84 has formed thereon, at least one secondary male locking tab 88 as well as at least one primary female locking opening 86. In the preferred embodiment shown in FIG. 14 the production blank is formed with two such primary and secondary openings and tabs. In a like manner the outer flap 110 and flap 112 have formed thereupon at least one primary male locking tab 124 while the flap 112 has formed thereupon at least one secondary female locking opening 128 of the type hereinbefore described. In the preferred embodiment shown in FIG. 14 the end panel has formed two of these primary and secondary tabs and openings. It should be obvious from a study of FIG. 14 that the inner flap 84 with its primary and secondary locking members is designed to be juxtapositioned with the outer flap 110 and flap 112 and their primary and secondary locking members.

Figure 15:
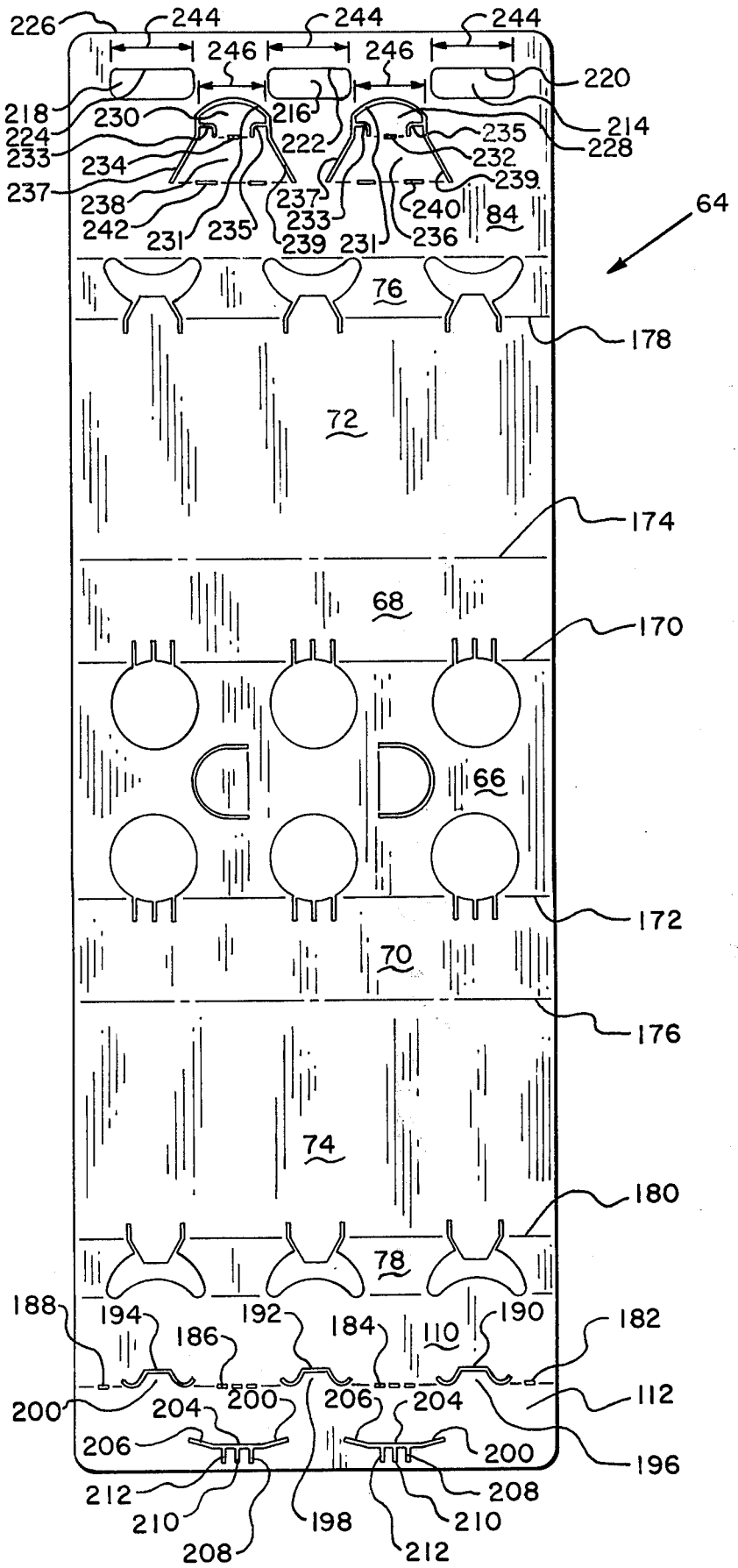
FIG. 15 is a view of the production blank for the type of package that is generally referred to as a "wrap-around" package and showing the applicants' new and improved locking structure placed there upon.

Referring now to FIG. 15 of the drawing there is shown a production blank of the "wrap-around" type which comprises a centrally positioned top portion 66 having formed on each side thereof, by means of scorelines 170 and 172 a pair of sides 68 and 70. The sides 68 and 70 have formed on each side thereof, by means of the scorelines 174 and 176, a pair of sides 72 and 74 which in turn have formed on each side thereof, by means of the scorelines 178 and 180, a pair of sides 76 and 78.

Formed on each side of the sides 76 and 78, are inner flaps 84 and outer flaps 110. The inner flap 110 is formed in two sections by means of the cut and scorelines 182, 184, 186 and 188 in combination with the die cut lines 190, 192 and 194. As a result of this there is formed the beforementioned primary male locking tabs 196, 198 and 200 which corresponds to the primary male locking tabs 124 described before in reference to FIG. 13 of the drawing. Formed in the flap 112, by means of the die cut lines 202, 204, 206, 208, 210 and 212, are a plurality of secondary female locking openings of the type hereinbefore described as numeral 128 when referring to FIG. 13 of the drawing.

Formed in the inner flap 84 are a plurality of primary female locking openings 214, 216 and 218 which are formed as an elongated rectangular-shaped opening having at least one straight edge 220, 222, and 224 which lies substantially parallel to the edge 226 of the inner flap 84.

Also formed in the inner flap 84 and spaced a predetermined distance apart from the primary female locking openings 214, 216 and 218, are a plurality of secondary male locking tabs 228 and 230 which are hingedly attached, by means of the cut and scorelines 232 and 234 to a pair of tabs 236 and 238. The tabs 236 and 238 are formed out of the inner flap 84 by means of the plurality of die cuts 231, 233, 235, 237 and 239. The tabs 236 and 238 are hingedly attached, by means of the cut and scorelines 240 and 242 to the inner flap 84.

By locating the secondary male locking tabs 228 and 230 a predetermined distance and apart from the primary female locking openings 214, 216 and 218 then the production blank is able to be constructed so that the primary female locking opening length, as shown by the arrow distance 244 was able to be constructed of a length longer than the secondary male locking tab shown by the arrow distance 246. Practically speaking, this means then that the size of the secondary male locking tab does not control the size of the primary female locking opening and primary male locking tabs.

In the preferred embodiment shown, the wrap-around blank has been constructed with three primary locking members and two secondary locking members, however, it is within the spirit and scope of the invention that the blank could be formed with more or less locking members according to the particular design of the package.

From the foregoing it can be seen that there has been provided by the subject invention a new and novel folding carton package of the type wherein the inner and outer flap portions are double locked together and the female primary lock is physically separated from and spaced a distance apart from the male secondary lock thereby resulting in greater latitude in forming the package and greater strength to the package. The subject new and novel invention can be utilized on a wrap-around package of the type shown in FIG. 15 and can also be utilized with an end-loaded package of the type shown in FIG. 14 as well as with other types of packages without departing from the spirit and scope of the invention.

From the foregoing it can also be seen that there has been provided a new and novel invention which accomplishes all the objects and advantages of the invention as beforementioned. It should be apparent, however, that many changes can be made in the invention and the particular location of the various parts of the invention without departing from the spirit and scope thereof and the foregoing description of the preferred embodiment has been given by way of illustration only.

Having described our invention, we claim:

1. In a folding carton package of the type having an inner and an outer flap double locked together, said flaps having an elongated edge thereon, the improvement comprising:
   a. the inner flap having formed thereon a primary female locking opening adjacent to the edge of the inner flap; and
   b. the inner flap also having formed thereon a secondary male locking tab located adjacent to and separate from said primary female locking opening.

2. The improvement as defined in claim 1 wherein said primary female locking opening is formed of a predetermined length which is longer than the length of the secondary male locking tab.

3. The improvement as defined in claim 2 wherein said primary female locking opening is formed as an elongated rectangular shaped opening having at least one straight edge portion lying parallel to the edge of the inner flap.

4. The improvement as defined in claim 3 wherein the edge of the primary female locking opening opposite to the straight edge portion is formed in a generally semi-circular configuration.

5. The improvement as defined in claim 4 wherein said secondary male locking tab is formed as an elongated tab having a hinged semi-circular portion formed on the end thereof.

6. The improvement as defined in claim 5 wherein the semi-circular configuration of the edge opposite to the straight edge portion is substantially the same radius as the radius of the hinged semi-circular portion formed on the end of the elongated tab.

7. The improvement as defined in claim 1 wherein the separation between the primary female locking opening and the secondary male locking tab is approximately one-eighth inch.

8. An improved folding carton blank, comprising:
   a. a centrally positioned bottom;
   b. a pair of sides hingedly attached to said bottom;
   c. at least one of said sides having formed thereon a top;
   d. said sides having formed thereon and positioned on each side thereof an inner flap and an outer flap, each inner flap having formed thereon at least one secondary male locking tab and at least one primary female locking opening, each outer flap having formed thereon at least one primary male locking tab and at least one secondary female locking opening; and
   e. said secondary male locking tab being formed separate from and spaced a pre-determined distance from said primary female locking opening.

9. The carton blank as defined in claim 8 wherein said primary female locking opening is formed of a pre-determined length which is longer than the length of the secondary male locking tab.

10. The carton blank as defined in claim 8 wherein said primary female locking opening is formed as an elongated rectangular shaped opening having at least one straight edge portion lying parallel to the edge of the inner flap.

11. The carton blank as defined in claim 10 wherein the edge of the primary female locking opening opposite to the straight edge portion is formed in a generally curved semi-circular configuration.

12. The carton blank as defined in claim 11 wherein said secondary male locking tab is formed as an elongated tab having a hinged semi-circular portion formed on the end thereof.

13. The carton blank as defined in claim 12 wherein the semi-circular configuration of the edge opposite to the straight edge portion is substantially the same radius as the radius of the hinged semi-circular portion formed on the end of the elongated tab.

14. The carton blank as defined in claim 8 wherein the separation between the primary female locking opening and the secondary male locking tab is approximately one-eighth of an inch.

15. An improved folding carton blank comprising:

a. a centrally positioned top;

b. a plurality of sides, hingedly attached to said top;

c. an inner flap hingedly attached to one of said sides with an outer flap hingedly attached to the other of said sides;

d. one of said flaps having formed thereon a plurality of primary female locking openings and a plurality of secondary male locking tabs;

e. the other of said flaps having formed thereon a plurality of primary male locking tabs and a plurality of secondary female locking openings; and f. said primary female locking openings being formed separate from and spaced apart at a pre-determined distance from said secondary male locking tabs.

16. The carton blank as defined in claim 15 wherein said primary female locking openings are formed of a predetermined length which is longer than the length of the secondary male locking tabs.

17. The carton blank as defined in claim 15 wherein said primary female locking openings are formed as elongated rectangular shaped openings having at least one straight edge portion lying parallel to the edge of the inner flap portion.

18. The carton blank as defined in claim 17 wherein the edge of the primary female locking openings opposite to the straight edge portion are formed in a generally curved semicircular configuration.

19. The carton blank as defined in claim 18 wherein said secondary male locking tabs are formed as elongated tabs having a hinged semi-circular portion formed on the end thereof.

20. The carton blank as defined in claim 19 wherein the semi-circular configuration of the edge opposite to the straight edge portion is substantially the same radius as the radius of the hinged semi-circular portion formed on the end of the elongated tab.

21. The carton blank as defined in claim 15 wherein the separation between the primary female locking openings and the secondary male locking tabs are approximately one-eighth of an inch.

* * * * *

UNITED STATES PATENT OFFICE

CERTIFICATE OF CORRECTION

PATENT NO. : 3,945,560

DATED : March 23, 1976

INVENTOR(S) : Glen R. Harrelson, Earle C. Sherman

It is certified that error appears in the above-identified patent and that said Letters Patent are hereby corrected as shown below:

Column 3, line 54, delete "male secondary" and insert in place thereof -- secondary male --.

Column 4, line 45, before "package" insert -- end-filled --.

Column 4, line 46, before "package 64" insert -- wrap-around--.

Column 4, line 46, before "shown" delete -- wrap-around --.

Column 6, line 1, before "cutline" insert -- die --.

Column 6, line 3, before "cut line" insert -- die --.

Column 6, line 6, before "tab" insert -- secondary male locking --.

Column 6, line 6, after "tab" insert -- 88 --.

Column 6, line 29, delete -- panel --.

Column 6, line 40, delete "panel" and insert in place thereof -- flap --.

Column 7, line 2, delete "inner" and insert in place thereof -- outer --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*